US006760927B2

(12) United States Patent
Guay

(10) Patent No.: US 6,760,927 B2
(45) Date of Patent: Jul. 13, 2004

(54) DEVICE FOR ADJUSTING HEAD BAND FOR PROTECTIVE HELMET

(76) Inventor: Louis Guay, Cotton, F-01400, Châtillon sur Chalaronne (FR)

( * ) Notice: Subject to any disclaimer, the term of this patent is extended or adjusted under 35 U.S.C. 154(b) by 0 days.

(21) Appl. No.: 10/181,923

(22) PCT Filed: Jan. 26, 2001

(86) PCT No.: PCT/FR01/00265

§ 371 (c)(1),
(2), (4) Date: Oct. 29, 2002

(87) PCT Pub. No.: WO01/54525

PCT Pub. Date: Aug. 2, 2001

(65) Prior Publication Data

US 2003/0106138 A1 Jun. 12, 2003

(30) Foreign Application Priority Data

Jan. 28, 2000 (FR) ..... 00 01094

(51) Int. Cl.[7] ..... A42B 1/22
(52) U.S. Cl. ..... 2/418
(58) Field of Search ..... 2/417, 418, 419, 2/420, 416, 183, DIG. 11

(56) References Cited

U.S. PATENT DOCUMENTS 3,079,609 A * 3/1963 Hoffmaster ..... 2/8
3,500,474 A * 3/1970 Austin ..... 2/418
3,992,720 A * 11/1976 Nicolinas ..... 2/418
4,727,630 A * 3/1988 Alan ..... 24/593.11
4,888,831 A * 12/1989 Oleson ..... 2/420
5,077,836 A * 1/1992 Idoff et al. ..... 2/10
5,608,917 A * 3/1997 Landis et al. ..... 2/418
5,752,298 A * 5/1998 Howell ..... 24/593.1
5,950,245 A * 9/1999 Binduga ..... 2/417
6,032,297 A * 3/2000 Barthold et al. ..... 2/416
6,219,851 B1 * 4/2001 Fang ..... 2/418
6,219,889 B1 * 4/2001 Lovato et al. ..... 24/170
6,314,588 B1 * 11/2001 Fang ..... 2/418
6,332,227 B1 * 12/2001 Fang ..... 2/418
6,341,382 B1 * 1/2002 Ryvin et al. ..... 2/417
6,457,210 B1 * 10/2002 Shirai et al. ..... 24/16 PB
6,481,019 B2 * 11/2002 Diaz et al. ..... 2/171.3

FOREIGN PATENT DOCUMENTS

DE 29811119 10/1998
GB 2098459 A * 11/1982 ..... A42B/3/00
JP 10317223 12/1998

* cited by examiner

*Primary Examiner*—Rodney M. Lindsey
(74) *Attorney, Agent, or Firm*—Greenblum & Bernstein, P.L.C.

(57) ABSTRACT

Protective helmet that includes a shell adapted to protect a user's head, an inner lining, and a headband having an adjusting device. The adjusting device includes two gripping members adapted to be manually moved towards or away from one another by the user in order to vary a size of the headband. This abstract is neither intended to define the invention disclosed in this specification nor intended to limit the scope of the invention in any way.

39 Claims, 9 Drawing Sheets

FIG 9
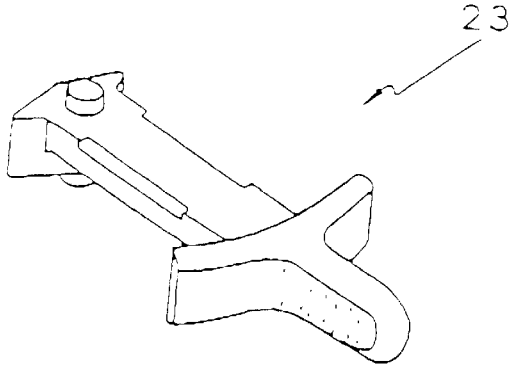
FIG 10a
FIG 10b
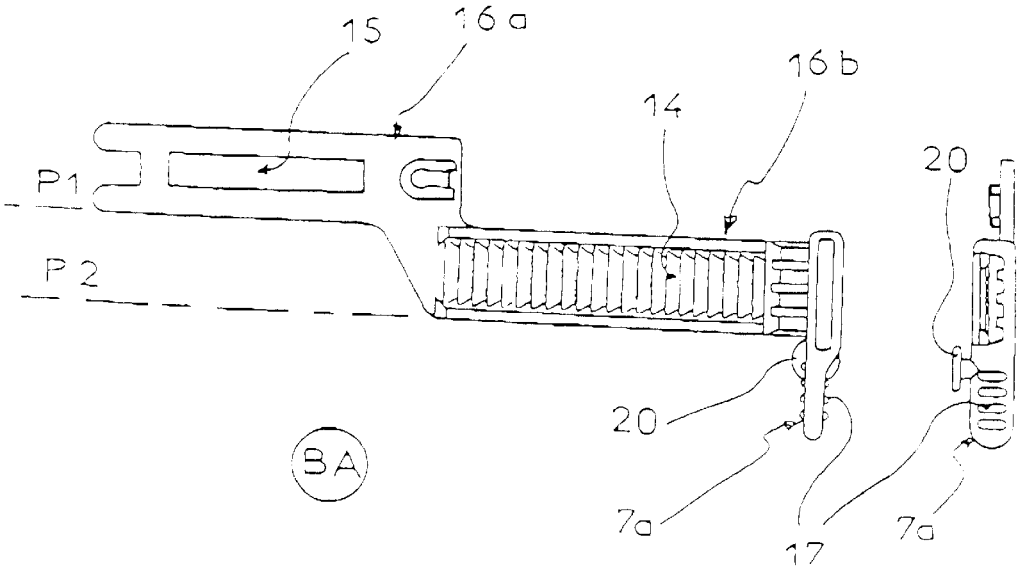

DEVICE FOR ADJUSTING HEAD BAND FOR PROTECTIVE HELMET

CROSS-REFERENCE TO RELATED APPLICATIONS

The present application is a National Stage Application of International Application No. PCT/FR01/00265, filed Jan. 26, 2001. Further, the present application claims priority under 35 U.S.C. § 119 of French Patent Application No. 00 01094 filed on Jan. 28, 2000.

BACKGROUND OF THE INVENTION

1. Field of the Invention

The present invention relates to a protective helmet, and more specifically a device for adjusting the helmet adapted to promote its positioning and adjusting as well as its fitting to the size of the user's head.

2. Discussion of Background Information

Protective helmets have long been commonly used in various fields, whether for professional use as is the case for the military, plane or helicopter pilots, the police, or firefighters, or for civil or private use, as is the case for motorcycle riders, rally or race car drivers, or workers on a worksite.

These prior art helmets are generally formed of an external rigid shell and an inner liner adapted to allow the positioning of the helmet and to promote the comfort of the user. They can also comprise an inner envelope of a synthetic material adapted to dampen the impacts.

In these helmets, multiple types of adjustments are known to allow a precise positioning of the helmet and an adequate tightening of the tightening means in order to give optimum comfort to the one using the helmet. However, the prior art adjusting devices are not entirely satisfactory as they do not allow a sufficiently precise adjustment or require one to remove the helmet in order to carry out these adjustments. Additionally, they are generally complicated to implement and often require long and tedious handling.

Thus, the prior art adjusting devices present drawbacks related to their implementation, use and reliability. The object of the present invention is to overcome the aforementioned drawbacks through arrangements that are simple, reliable, easy to implement and inexpensive. The invention proposes a protective helmet whose adjustment device is easy to use, quick and precise so as to promote the fitting of the helmet to the size of the user's head.

SUMMARY OF THE INVENTION

According to its main characteristic, the protective helmet of the invention is of the type formed of a shell adapted to protect the user's head and comprising an inner lining that has a headband of adjustable size due to an adjusting device, and it is characterized in that the adjusting device has two gripping members adapted to be manually brought together or spread apart by the user in order to vary the size of the headband.

According to another characteristic of the protective helmet, the headband has a main band portion, two adjustment extensions that extend to the ends of the main band and bear the gripping arrangements, as well as a connecting element having locking arrangements adapted to cooperate with the adjustment extensions.

According to a complementary characteristic of the protective helmet, the cooperation between the adjustment extensions and the locking arrangements of the connecting element occurs by a rack system.

According to the preferred embodiment of the protective helmet of the invention, the headband is arranged on the inside of the helmet shell such that the connecting element is positioned at the rear of the helmet and that the gripping members are arranged substantially in the zone corresponding to the user's nape.

According to another characteristic of the protective helmet, it is characterized in that the gripping members are arranged at the end of the adjustment extensions and have a transverse support surface extending downwardly (BA) below the planes containing the main band and the adjustment extensions.

According to an additional characteristic of the protective helmet of the invention, it is characterized in that it comprises elastic biasing system arranged between the connecting element and the adjustment extensions or the band in order to bias the headband towards its loosened position against the locking arrangements.

According to the preferred embodiment of the protective helmet, the elastic biasing system is formed by two return arms connecting the adjustment extensions to the connecting element and which bias the extensions due to their specific elasticity.

According to another characteristic of the protective helmet of the invention, it is characterized in that the locking arrangement is constituted of two locking buckles that each comprise a locking lever bearing a locking projection adapted to cooperate with notches arranged on the external surface of the adjustment extensions and which each comprise an unlocking member.

According to a complementary characteristic of the protective helmet, it is characterized in that the adjustment extensions comprise at their end, at the level of their gripping members, a guiding pin adapted to guide the sliding of the adjustment extensions with respect to the locking arrangements of the connecting element by sliding each one in a guiding slot arranged in the connecting element.

Furthermore, it is noted that according to an alternative embodiment of the protective helmet, the gripping members are separated by a distance less than 15 centimeters.

The invention also provides for a protective helmet comprising a shell adapted to protect a user's head, an inner lining, a headband comprising an adjusting device. The adjusting device includes two gripping members adapted to be manually moved towards or away from one another by the user in order to vary a size of the headband.

The two gripping members may be adapted to be manually moved towards and away from one another by the user in order to vary a size of the headband. The headband may comprise a main band portion having two ends and an adjustment extension arranged at each end of the main band. Each adjustment extension may comprise one of the two gripping members. The headband may further comprise a connecting element. The connecting element may comprise a locking system adapted to cooperate with the adjustment extensions. The locking system may comprise two buckles each having a locking projection which engages notches of each adjustment extension. The locking system may comprise a rack system. The headband may be arranged on an inside of the shell. The headband may further comprise a connecting element positioned at a rear part of the helmet, and wherein the gripping members are arranged substantially in a zone corresponding to the user's nape. The headband may comprise a main band portion having two ends and an adjustment extension that is arranged at each end of the main band, whereby one gripping member is arranged on each adjustment extension. The headband may comprise a main band portion having two ends and an adjustment extension that is arranged at each end of the main band, whereby one gripping member is arranged on an end of each of the adjustment extensions.

Each gripping member may comprise a support surface that extends downwardly and transversely relative to a plane running through the headband. The headband may comprise a main band portion having two ends and an adjustment extension that is arranged at each end of the main band, whereby one gripping member is arranged on an end of each of the adjustment extensions. The main headband portion may be arranged on a first plane and the adjustment extensions may be arranged on a second plane, the first and second planes being parallel to one another and being spaced apart by a distance.

The protective helmet may further comprise an elastic biasing system acting to bias open the headband. The headband may comprise a main band portion having two ends, an adjustment extension that is arranged at each end of the main band, and a connecting element, whereby one gripping member is arranged on an end of each of the adjustment extensions. Each end of the main band portion may be connected to each adjustment extension and each adjustment extension may be connected to an end of the connecting element. The elastic biasing system may comprise arms which are connected to each adjustment extension in order to bias the headband towards a loosened position. The connecting element may comprise the elastic biasing system. The connecting element may comprise a system that locks each adjustment extension. The system that locks each adjustment extension may comprise two buckles each having a locking projection which engages notches in each adjustment extension. The system that locks each adjustment extension may comprise two buckles each having a locking lever and a projection which engages notches in each adjustment extension. The system that locks each adjustment extension may comprise two buckles each having an unlocking member, a locking lever, and a projection which engages notches in each adjustment extension. The elastic biasing system may comprise two return arms connecting the adjustment extensions to the connecting element, whereby the two return arms bias the adjustment extensions due to their specific elasticity.

The headband may comprise a main band portion having two ends, an adjustment extension that is arranged at each end of the main band, and a connecting element connected to each adjustment extension at two locations, whereby one gripping member is arranged on an end of each of the adjustment extensions. The headband may comprise a main band portion having two ends, an adjustment extension that is arranged at each end of the main band, and a connecting element connected to each adjustment extension. Each adjustment may comprise a guiding device adapted to slidingly engage the connecting element. Each guiding device may comprise a pin which engages a guiding slot in the connecting element. The connecting element may comprise a system that locks each adjustment extension, the system that locks each adjustment extension comprising two buckles each having a passage which allows the adjustment extension to slide within, an unlocking member, a locking lever, and a projection which engages notches in each adjustment extension.

The gripping members may be separated by a distance "d" of less than 15 centimeters when the headband is in a loosened position.

The invention also provides for a protective helmet having a shell that protects a user's head, an inner lining system, an adjustable headband system, wherein the adjusting headband system comprises a main headband portion having a first end and a second end. A first adjustment extension device is coupled to the first end. A second adjustment extension device is coupled to the second end. Each of the first and second adjustment extension devices comprises a gripping member. A connecting element is coupled to the each of the first and second adjustment extension devices. The connecting element comprises an elastic biasing system which causes the gripping members to be biased away from one another.

The invention also provides for a protective helmet having a shell that protects a user's head, an inner lining system, an adjustable headband system, wherein the adjusting headband system comprises a main headband portion having a first end and a second end. A first adjustment extension device is coupled to the first end. A second adjustment extension device is coupled to the second end. Each of the first and second adjustment extension devices comprises a gripping member. A connecting element has a portion that is non-movably coupled to each of the first and second adjustment extension devices. Each of the first and second adjustment extension devices is movably coupled to another portion of the connecting element. The connecting element comprises at least one of an elastic biasing system adapted to move the gripping members away from one another and a system that adjustably locks each adjustment extension at a number of positions.

BRIEF DESCRIPTION OF THE DRAWINGS

Other characteristics and advantages of the invention will become apparent from the following description, with reference to the attached drawings, which are given only as non-limiting examples.

FIGS. 1–11 show a preferred embodiment of the protective helmet of the invention and its adjusting device, wherein:

FIG. 1 is a perspective view of a protective helmet;

FIG. 2 is a perspective view of the inside of the protective helmet;

FIG. 3 is a perspective view of the headband and its adjusting device;

FIG. 4 is an exploded view of the headband and its adjusting device;

FIG. 7 is a perspective view of the adjusting device;

FIG. 9 is a perspective view of the unlocking lever;

FIGS. 10*a* and 10*b* are a front view and a lateral view of the adjustment extensions and their gripping member;

FIG. 11 is a rear view of the middle connecting element on which the adjustment occurs.

DETAILED DESCRIPTION OF THE INVENTION

Figure 1:
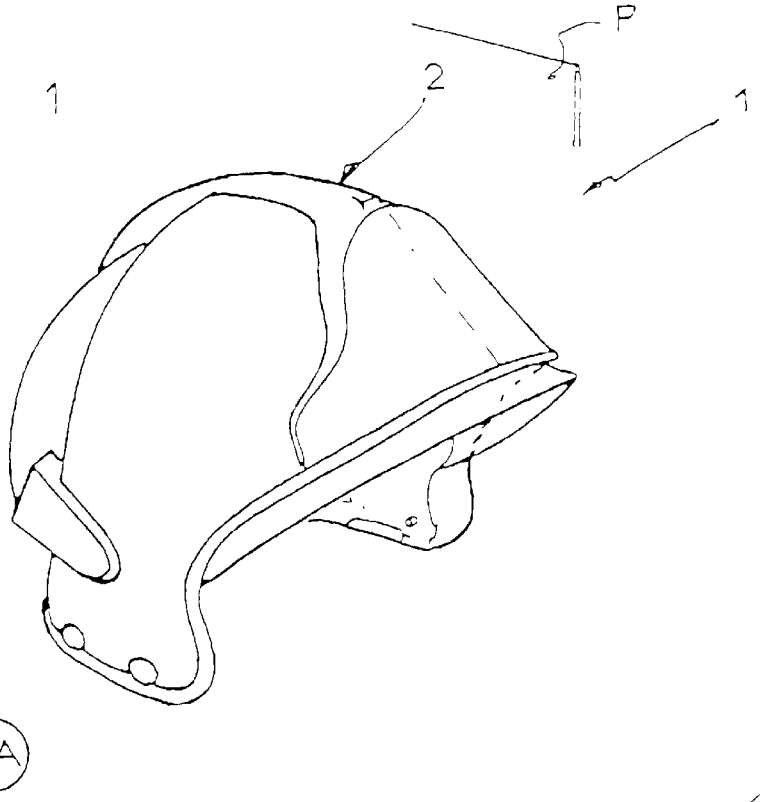

The protective helmet having the general reference numeral 1 is adapted to protect the user's head and can be of any type, i.e., a firefighter's helmet or a military helmet, for example, but also a helmet for a mountain climber, a bicyclist, or any other type of helmet, without leaving the scope of protection for the invention.

Figure 2:
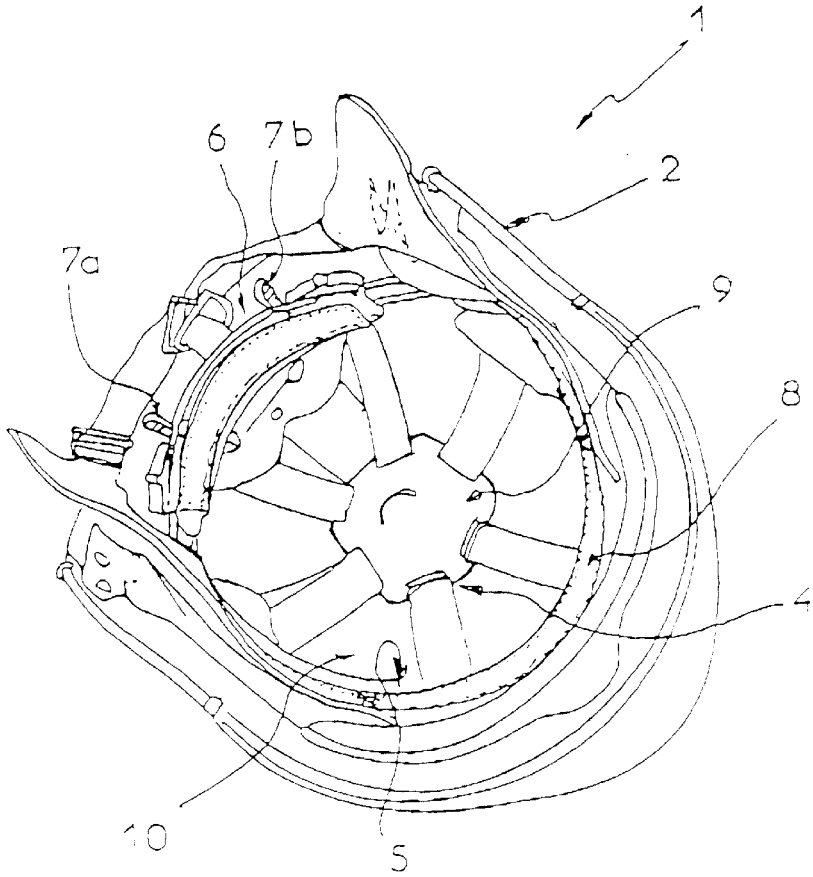

According to a preferred embodiment of the invention, it is a firefighter's helmet 1 as shown in FIGS. 1 and 2. It is constituted of an external shell 2, advantageously made in one piece, that is adapted to surround the user's head, and of an inner lining 10 arranged on the inside of the shell to allow the positioning and the tightening thereof around the head. In particular, this lining 10 has a cap 4 formed of a flexible wall or a holding net 9 and a headband 5 whose size is adjustable due to an adjusting device 6.

According to the preferred embodiment of the helmet 1 of the invention, the headband 5 is adapted to surround the user's head to promote the hold of the helmet once it is positioned. The adjusting device 6 thus allows varying the useful length of the headband 5, i.e., its diameter. To this end, the adjusting device 6 of the invention comprises two gripping members 7*a* and 7*b* that are adapted to be manually actuated by the user in order to be spaced apart or brought together, their actuating allowing one to vary the diameter of the headband 5. These gripping members 7*a*, 7*b* extend downwardly BA below the headband 5, and more specifically, below the plane containing the lower edge of the headband so that they can be more easily gripped and actuated by the user when the helmet 1 is positioned on the head.

Figure 3:
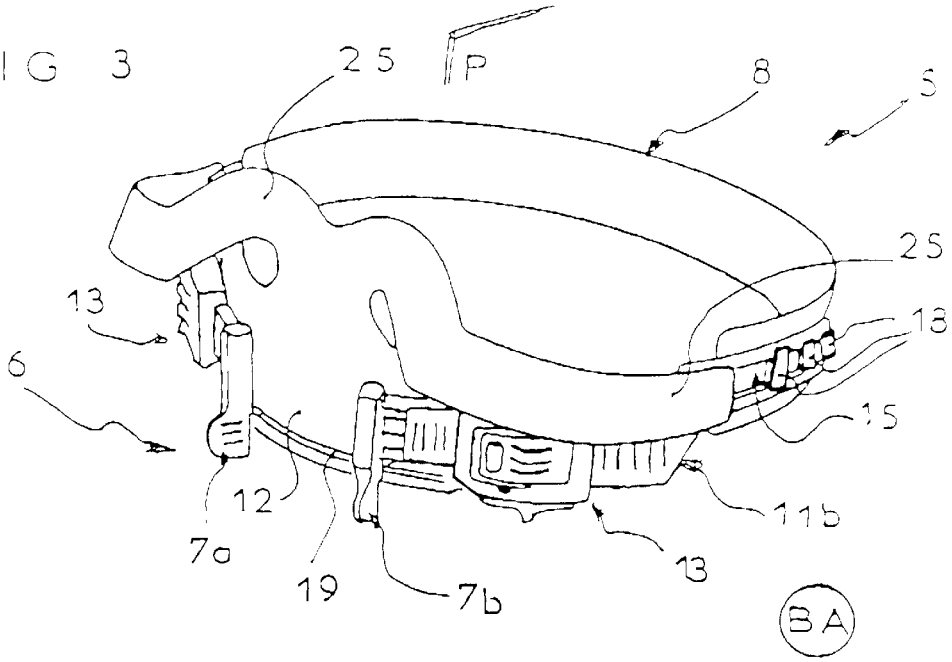
Figure 4:
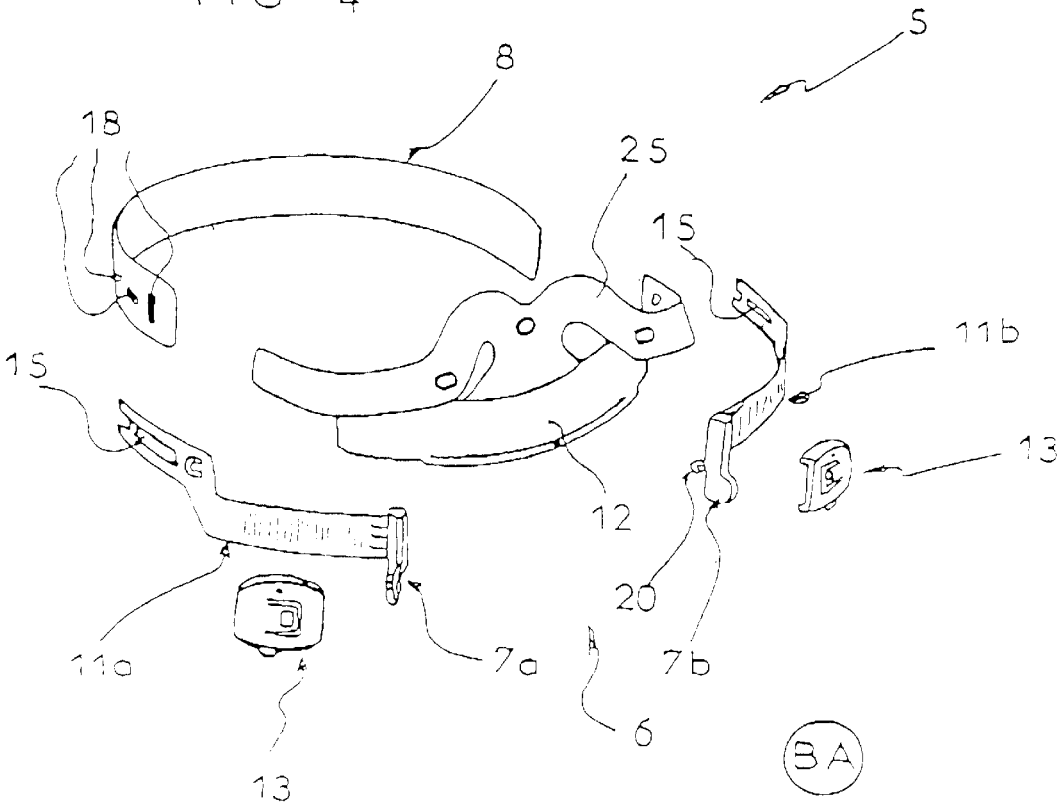

According to the preferred embodiment and as shown in FIGS. 3 and 4, the headband 5 is constituted by a main band portion 8, two adjustment extensions 11*a* and 11*b* arranged at the free ends of the band 8, a connecting element 12 and locking arrangements 13 born by the connecting element and adapted to cooperate with the adjustment extensions 11*a*, 11*b*. The cooperation between the locking arrangements 13 and the extensions 11*a*, 11*b* can be obtained by any system, such as a rack system as seen in the embodiment shown, for example, or by equivalent systems, such as wedging or the like. It is noted that the main band portion 8 forms at least half of the circumference of the headband 5.

According to the preferred embodiment of the helmet 1 of the invention, the gripping members 7*a*, 7*b* are borne by or arranged on the adjustment extensions 11*a*, 11*b* so as to extend below the headband 5. The adjustment extensions 11*a*, 11*b* bear, on their outer surface, a set of notches 14 (see e.g., FIG. 10*a*) adapted to cooperate with the locking member 13*a* of a buckle 13 that forms the locking arrangement. These extensions 11*a*, 11*b* have arranged, at one of their ends, the gripping member 7*a*, 7*b* and, at the other end, is arranged an attaching or assembly arrangement, such as a slot 15, in order to be each assembled to one end of the main band 8 so as to form the extension thereof.

It is noted, as shown in FIGS. 10*a* and 10*b*, that each adjustment extension 11*a*, 11*b* comprises a first longitudinal wall portion 16*a* adapted to extend the main band, and a second longitudinal wall portion 16*b* affixed to the first portion 16*a*, and which bears the set of notches 14. These two wall portions are arranged off-centered, one with respect to the other, in order to be placed in two distinct and parallel planes P1, P2. In this way, the second wall portion 16*b* is located below the first 16*a*. This second wall portion 16*b* bears or includes, at its free end, the gripping member 7*a*, 7*b* that is formed at least partially of a transverse wall portion that is orthogonal to it. This member thus has a support surface 17 that is sufficient for allowing the user to bias it. This surface 17 extends transversely below the second wall portion 16*b* of the adjustment extension 11*a*, 11*b*.

It is noted that the assembly of the extensions 11*a*, 11*b* on the main band portion 8, due to attaching arrangement 15, can occur in a plurality of positions. As seen in FIG. 4, the slot 15 of the extensions is capable of cooperating with a plurality of positioning pins 18 of the band 8. Thus, this plurality of possible assemblies multiplies the possibilities for adjusting the size of the headband 5 by being advantageously combined with the adjusting device 6 of the invention. It is understood that one would not leave the scope of the invention by making the band and its adjustment extensions in one single piece.

According to the preferred embodiment of the helmet 1 of the invention, the locking buckles 13 adapted to cooperate with the extensions 11*a*, 11*b* are borne by or coupled to a rear connecting element 12 that partially forms the headband 5. The headband 5 is arranged in the helmet so that the connecting element 12 is arranged centrally at the rear of the helmet 1, substantially at the level of the user's nape.

This connecting element advantageously has two guiding slots 19 adapted to cooperate with a guiding pin 20 for each of the adjustment extensions 11*a*, 11*b* shown in FIG. 10*b*. It bears, at its lateral ends, two buckles 13 shown in FIGS. 8*a*–8*d*, each forming a passage 21 for the adjustment extensions 11*a*, 11*b*, and each bearing a locking member 13*a*, such as a central lever provided with a locking projection 22 adapted to cooperate with the notches 14 in order to allow the sliding of the extension 11*a*, 11*b* in the passage 21, solely in a direction corresponding to the tightening of the headband, and to prevent any sliding in the opposite direction. As known, the locking buckles 13 have an unlocking member 23 adapted to bias the lever 13*a* and its projection 22 so that the latter is no longer engaged with the notches 14, and so that the adjustment extensions 11*a*, 11*b* can slide in the opposite direction and thus allow loosening the headband 5.

According to the preferred embodiment of the adjusting device 6, the unlocking member 23 is a lever pivotally mounted on the body of the buckle 13 and adapted to cooperate with the locking lever 13*a* by way of complementary ramps, as known.

Figure 5A:
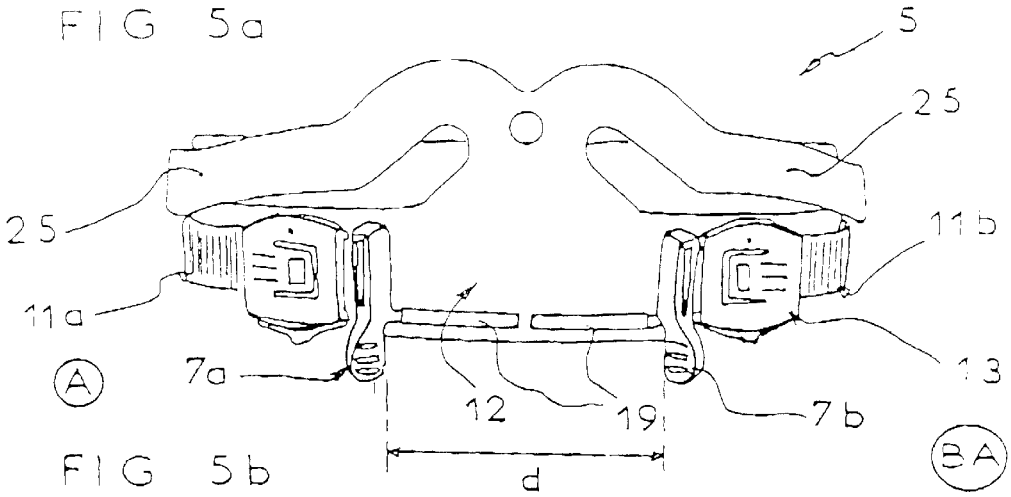
FIGS. 5*a*–5*c* are rear views of the loosened position, the intermediary position and the tightened position of the headband.
Figure 5B:
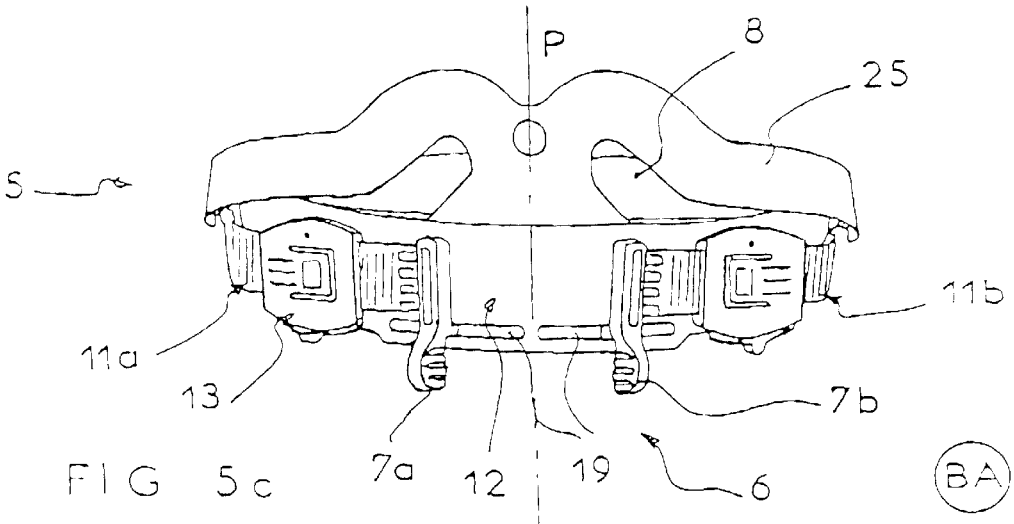
Figure 5C:
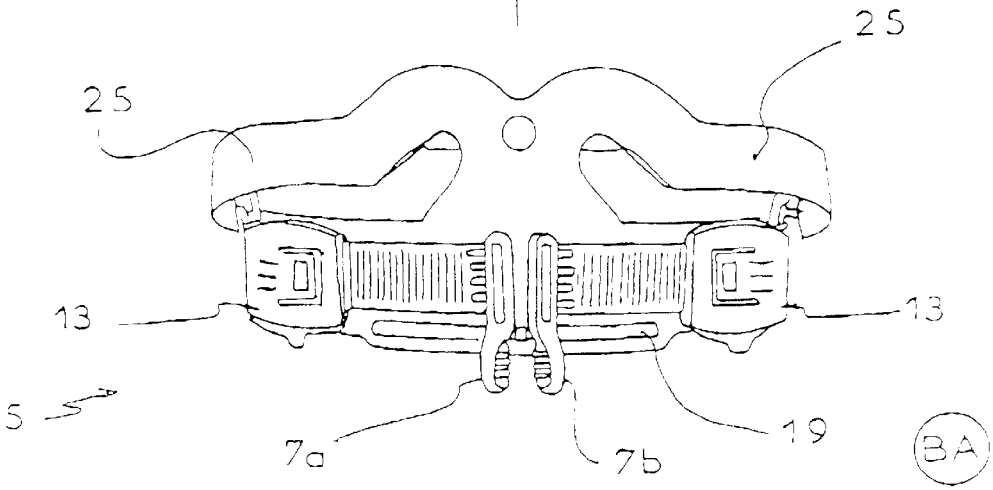
Figure 6A:
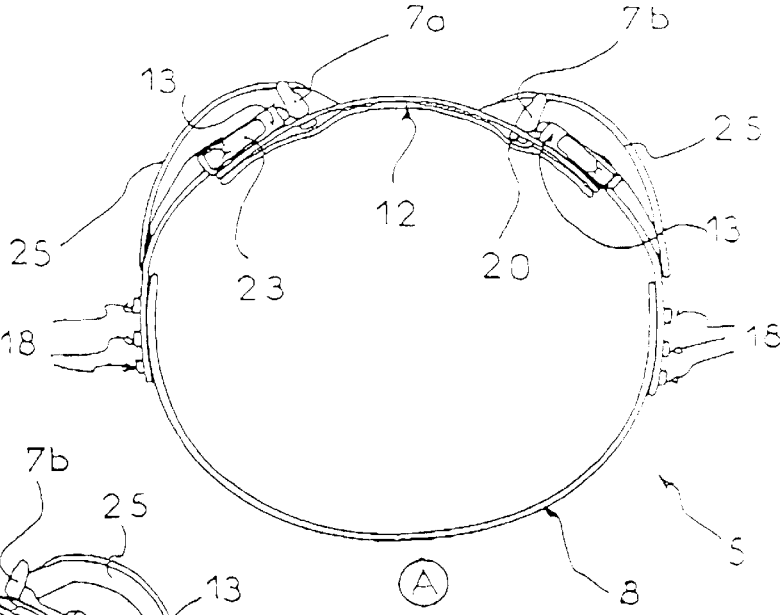
FIGS. 6*a*–6*c* are bottom views of the headband in the positions of FIGS. 5*a*–5*c*, respectively.

According to the invention, the headband 5 has elastic biasing system 25 adapted to bias it towards its loosened position A shown in FIGS. 5*a* and 6*a*, i.e., a position where the gripping members 7*a* and 7*b* abut against the buckles 13 of the connecting element. Thus, when the user actuates the loosening levers 23 of the buckles 13, the elastic biasing system or members 25 bias the adjustment extensions 11*a* and 11*b* to slide in their passage 21 toward their loosened position A.

Figure 6B:
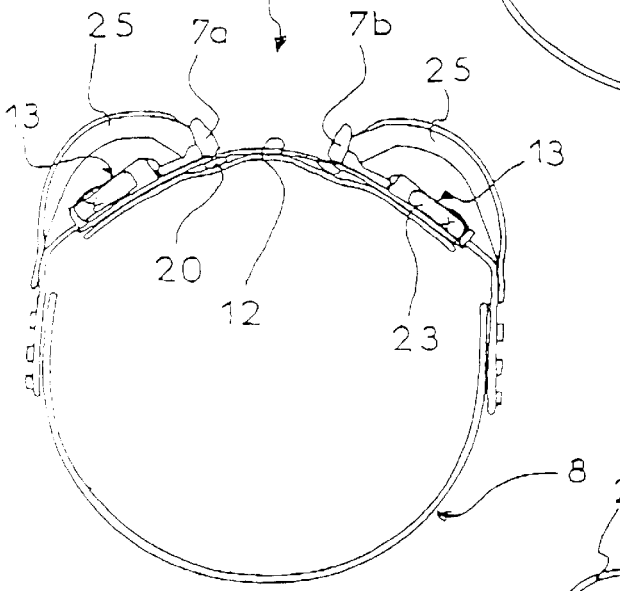
Figure 6C:
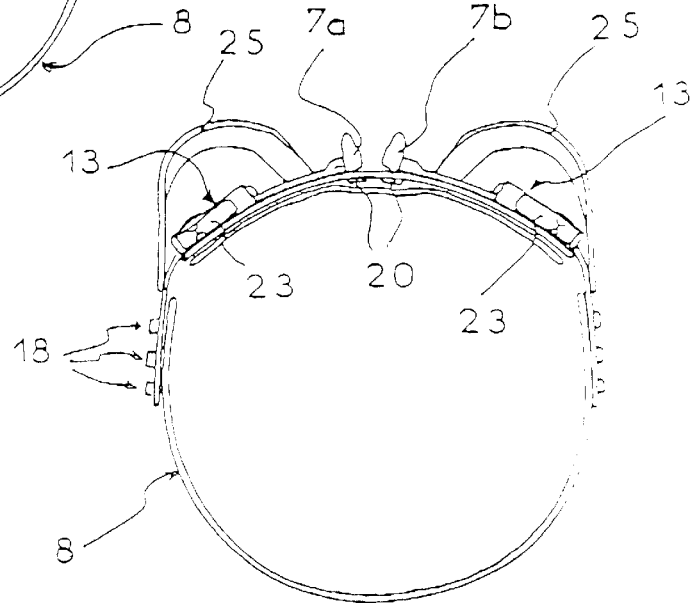

According to the preferred embodiment, the elastic biasing system or members 25 are constituted of two return arms 25 formed by extensions of the rear connecting element 12 and which connect element 12 to the adjustment extensions 11*a*, 11*b*. Thus, when the user tightens the headband 5, the return arms fold as seen in FIGS. 6*a*–6*c*, thus biasing the adjustment extensions 11*a*, 11*b* against the locking arrangements 13 and 22.

Figure 7:
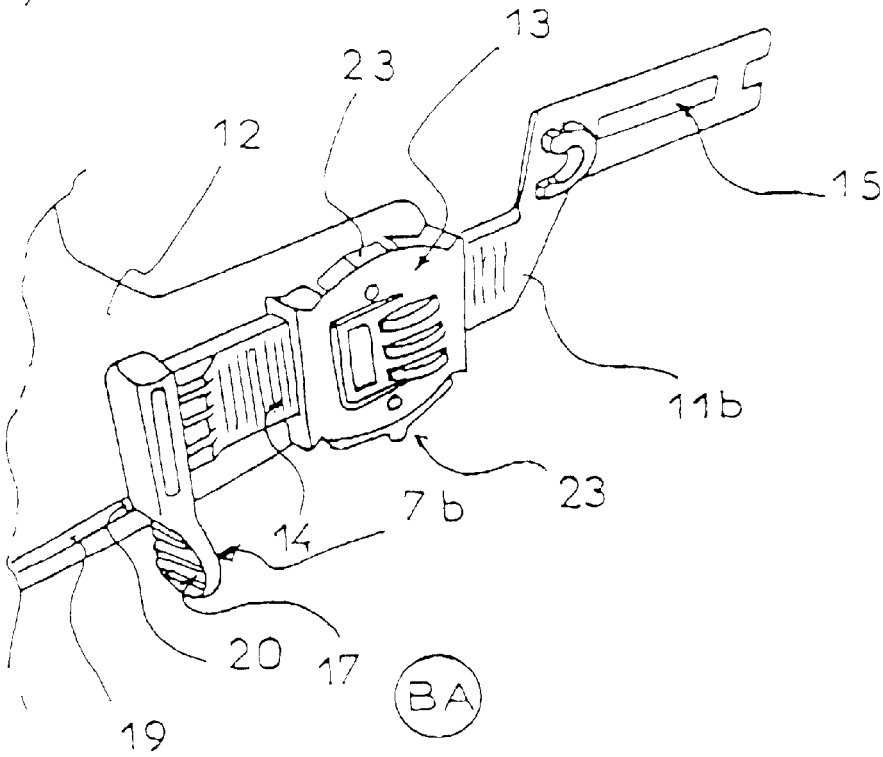
Figure 8A:
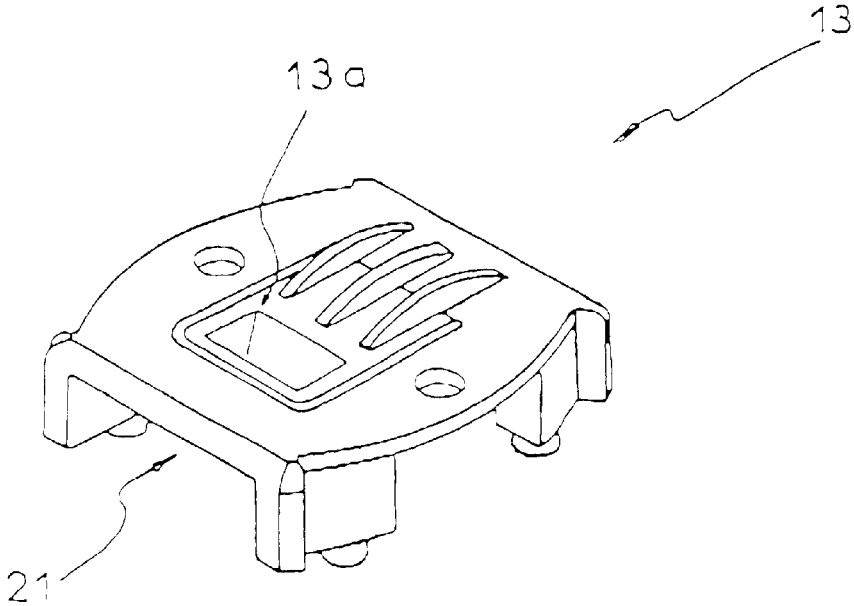
FIGS. 8*a*, 8*b*, 8*c*, 8*d* show the housing of the adjusting device, in perspective and top views, and in cross-section along AA and CC, respectively.
Figure 8B:
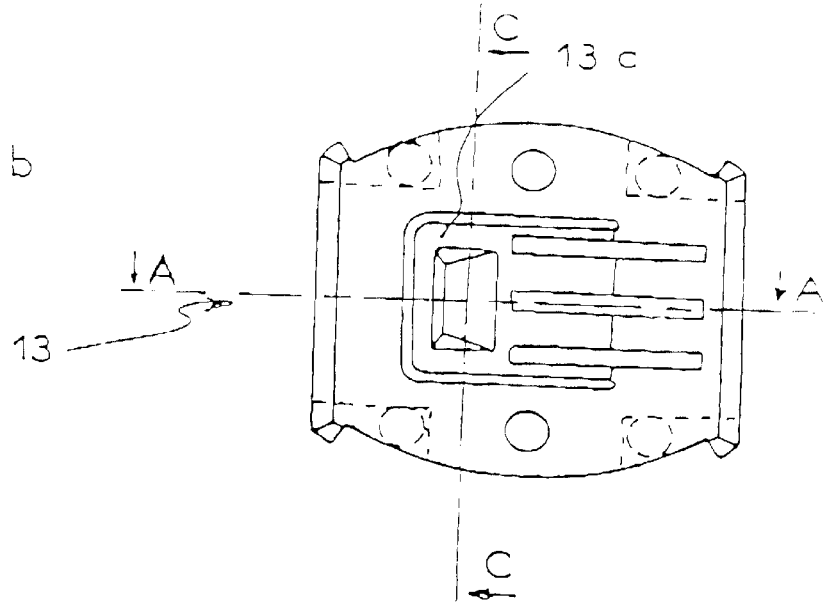
Figure 8C:
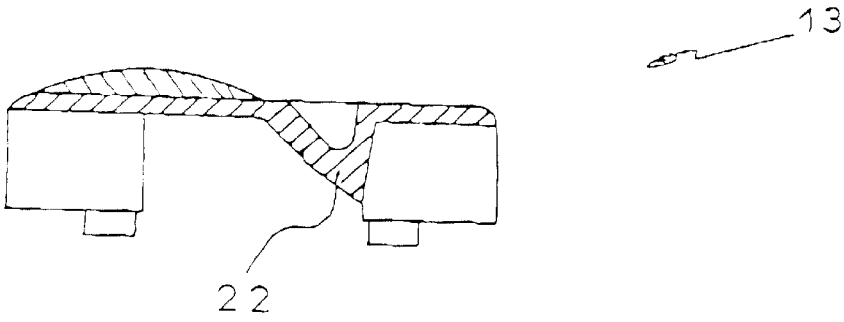
Figure 8D:
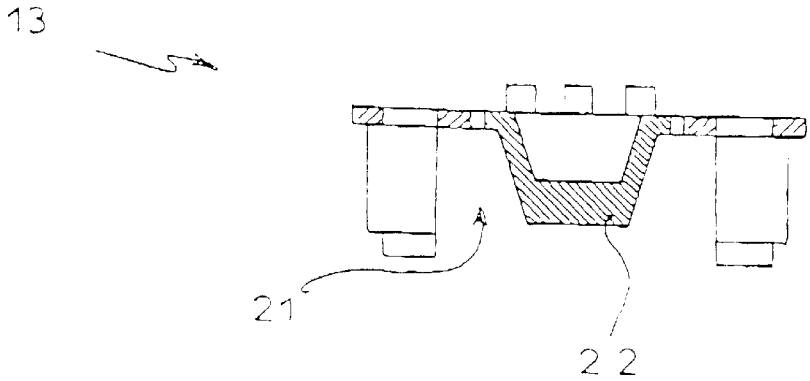
Figure 11:
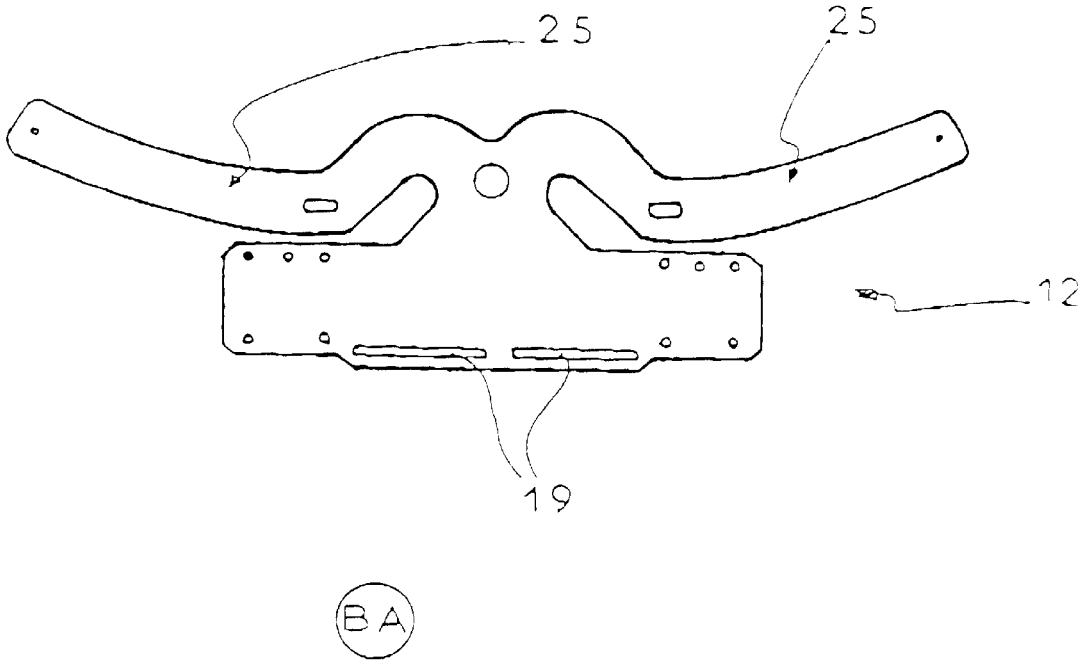

As shown in FIG. 7, it is noted that the guiding devices 20 are located at the end of the adjustment extensions, at the level of the gripping members 7*a*, 7*b* in order to slide in the slots 19 of the connecting element 12 located between the two locking buckles 13. Furthermore, when the headband 5 is in the loosened position A, the gripping members 7*a*, 7*b* are separated by a distance "d" which is less than 15 centimeters and advantageously equal to approximately 8 centimeters so as to facilitate their actuating by the user. It is also noted that the cooperation between the connecting element 12 and its buckles 13 and the adjustment extensions 11*a*, 11*b* occurs in a plane P2 located below that in which the main portion of the band 8 and the return arms 25 are located (i.e., P1), whereas the gripping members 7*a*, 7*b* extend downwardly below plane P2.

According to the preferred embodiment, the constitutive members of the headband 5, namely the main band portion 8, the adjustment extensions 11*a*, 11*b*, the arrangements for locking and unlocking 13, 22 and 23, the connecting element 12 and its return arms 25, are made of plastic and can be made by any method, such as by injection, for example.

Nevertheless, the main portion of the band 8 and the connecting element 12 can comprise, on their inner surface, a padding adapted to provide comfort for the user. This padding can advantageously be glued or sewn on the band 8, or it can be removably arranged, for example, by way of a quick fastener of the Velcro type (Registered Trademark).

Figure 12A:
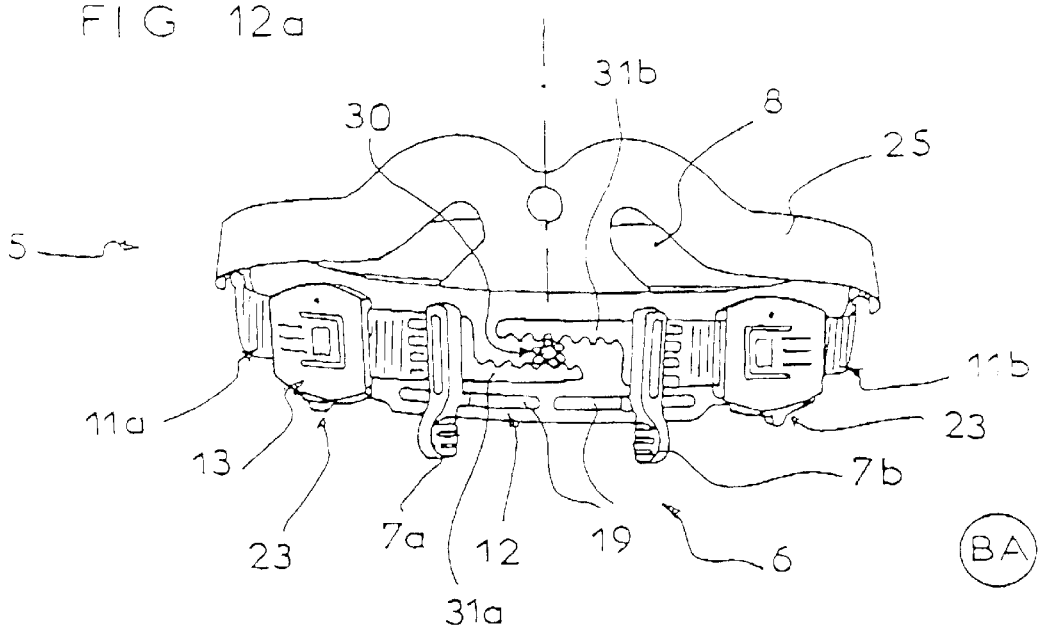
FIGS. 12*a* and 12*b* are views similar to FIG. 5*a*, showing two alternative embodiments according to which the headband has arrangements that enable the symmetrical displacement of the ends of the headband.
Figure 12B:
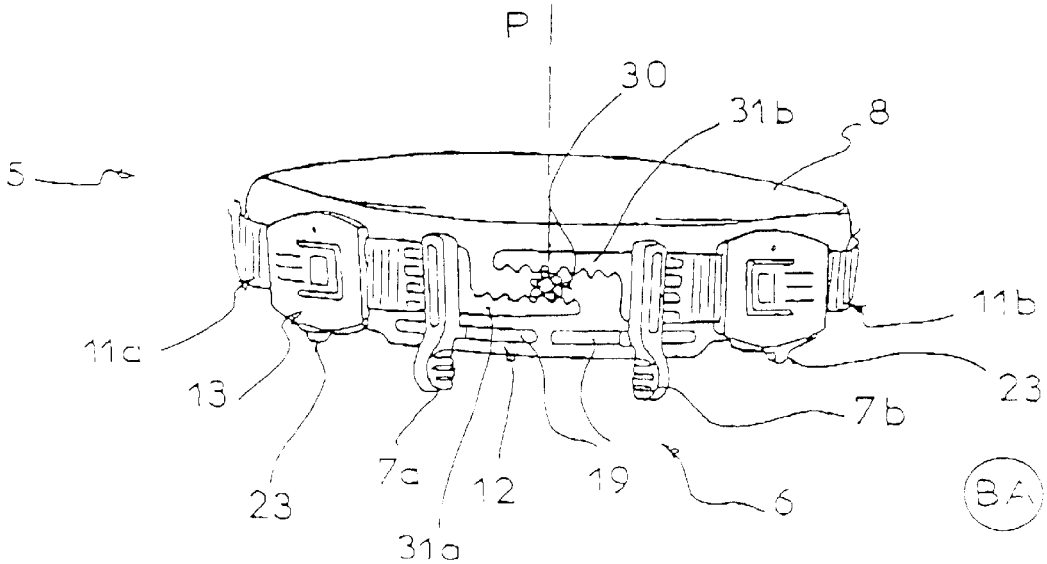

It is noted that the helmet 1 of the invention has a vertical plane P of general symmetry, and that it has arrangements allowing the adjustment extensions 11*a*, 11*b* to be displaced symmetrically with respect to this plane P. In the previously described embodiment, these arrangements include the elastic arms 25 such that, when the user unlocks the band due to his acting on the unlocking members 23, the elastic arms 25 act simultaneously and jointly to symmetrically drive back each of the adjustment extensions 11*a*, 11*b*. FIGS. 12*a*, 12*b* show an alternative according to which the displacement of one of the adjustment extensions 11*a* or 11*b* causes the displacement of the other adjustment extension 11*a* or 11*b*. According to this alternative, the two adjustment extensions 11*a*, 11*b* are connected mechanically and kinematically by a central transmission sprocket 30, rotatably mounted on the connecting element 12 in the general plane P. It is noted that sprocket 30 cooperates through diametrical meshing with two additional extensions 31*a*, 31*b* of the main band, extending the adjustment extensions 11*a*, 11*b*.

According to the alternative embodiment shown in FIG. 12*a*, the device also includes the elastic arrangements 25 of the first embodiment.

According to the alternative of FIG. 12*b*, the elastic arrangements are constituted of an elastic system, not shown, such as a spring that acts on the transmission sprocket 30.

Naturally, the invention is not limited to the embodiments described and shown by way of example, but it also encompasses all technical equivalents, as well as their combinations.

What is claimed is:

1. A protective helmet comprising:

a shell adapted to protect a user's head;

an inner lining;

a headband comprising an adjusting device; and the adjusting device including two gripping members adapted to be manually moved towards or away from one another by the user in order to vary a size of the headband, wherein the two gripping members have portions which extend downwardly from a plane running through a bottom surface of the headband.

2. The protective helmet of claim 1, wherein the two gripping members are adapted to be manually moved towards and away from one another by the user in order to vary a size of the headband.

3. The protective helmet of claim 1, wherein the headband comprises a main band portion having two ends and an adjustment extension arranged at each end of the main band portion.

4. The protective helmet of claim 3, wherein each adjustment extension comprises one of the two gripping members.

5. The protective helmet of claim 1, wherein the headband further comprises a connecting element.

6. The protective helmet of claim 1, wherein the connecting element comprises a locking system adapted to cooperate with adjustment extensions.

7. The protective helmet of claim 6, wherein the locking system comprises two buckles each having a locking projection which engages notches of each of the adjustment extensions.

8. The protective helmet of claim 6, wherein the locking system comprises a rack system.

9. The protective helmet of claim 1, wherein the headband is arranged on an inside of the shell.

10. The protective helmet of claim 1, wherein the headband further comprises a connecting element positioned at a rear part of the helmet, and wherein the gripping members are arranged substantially in a zone corresponding to the user's nape.

11. The protective helmet of claim 1, wherein the headband comprises a main band portion having two ends and an adjustment extension that is arranged at each end of the main band, whereby one gripping member is arranged on each adjustment extension.

12. The protective helmet of claim 1, wherein the headband comprises a main band portion having two ends and an adjustment extension that is arranged at each end of the main band, whereby one gripping member is arranged on an end of each of the adjustment extensions.

13. The protective helmet of claim 1, wherein each gripping member comprises a support surface that extends downwardly and transversely relative to a plane running through the headband.

14. The protective helmet of claim 13, wherein the headband comprises a main band portion having two ends and an adjustment extension that is arranged at each end of the main band portion, whereby one gripping member is arranged on an end of each of the adjustment extensions.

15. The protective helmet of claim 14, wherein the main headband portion is arranged on a first plane and wherein the adjustment extensions are arranged on a second plane, the first and second planes being parallel to one another and being spaced apart by a distance.

16. The protective helmet of claim 1, wherein the headband comprises a main band portion having two ends, an adjustment extension that is arranged at each end of the main band portion, and a connecting element connected to each adjustment extension at two locations, whereby one gripping member is arranged on an end of each of the adjustment extensions.

17. The protective helmet of claim 1, wherein the headband comprises a main band portion having two ends, an adjustment extension that is arranged at each end of the main band portion, and a connecting element connected to each adjustment extension.

18. The protective helmet of claim 17, wherein each adjustment extension comprises a guiding device adapted to slidingly engage the connecting element.

19. The protective helmet of claim 18, wherein each guiding device comprises a pin which engages a guiding slot in the connecting element.

20. The protective helmet of claim 19, wherein the connecting element comprises a system that locks each adjustment extension, the system that locks each adjustment extension comprising two buckles each having a passage which allows the adjustment extension to slide within, an unlocking member, a locking lever, and a projection which engages notches in each adjustment extension.

21. The protective helmet of claim 1, wherein the gripping members are separated by a distance "d" of less than 15 centimeters when the headband is in a loosened position.

22. A method of adjusting the protective helmet of claim 1, the method comprising:

moving the two gripping members towards by gripping the portions of the two gripping members below the plane running through a bottom surface of the headband; and locking the two gripping members in a desired position.

23. A protective helmet comprising:

a shell adapted to protect a user's head;

an inner lining;

a headband comprising an adjusting device;

the adjusting device including two gripping members adapted to be manually moved towards or away from one another by the user in order to vary a size of the headband; and an elastic biasing system acting to bias open the headband.

24. The protective helmet of claim 23, wherein the headband comprises a main band portion having two ends, an adjustment extension that is arranged at each end of the main band portion, and a connecting element, whereby one gripping member is arranged on an end of each of the adjustment extensions.

25. The protective helmet of claim 24, wherein each end of the main band portion is connected to each adjustment extension and wherein each adjustment extension is connected to an end of the connecting element.

26. The protective helmet of claim 25, wherein the elastic biasing system comprises arms which are connected to each adjustment extension in order to bias the headband towards a loosened position.

27. The protective helmet of claim 26, wherein the connecting element comprises the elastic biasing system.

28. The protective helmet of claim 27, wherein the connecting element comprises a system that locks each adjustment extension.

29. The protective helmet of claim 28, wherein the system that locks each adjustment extension comprises two buckles each having a locking projection which engages notches in each adjustment extension.

30. The protective helmet of claim 28, wherein the system that locks each adjustment extension comprises two buckles each having a locking lever and a projection which engages notches in each adjustment extension.

31. The protective helmet of claim 28, wherein the system that locks each adjustment extension comprises two buckles each having an unlocking member, a locking lever, and a projection which engages notches in each adjustment extension.

32. The protective helmet of claim 25, wherein the elastic biasing system comprises two return arms connecting the adjustment extensions to the connecting element, whereby the two return arms bias the adjustment extensions due to their specific elasticity.

33. A method of adjusting the protective helmet of claim 23, the method comprising:

moving the two gripping members towards each other against the biasing force of the elastic biasing system; and locking the two gripping members in a desired position.

34. A protective helmet having a shell that protects a user's head, an inner lining system, an adjustable headband system, wherein the adjusting headband system comprises:

a main headband portion having a first end and a second end;

a first adjustment extension device coupled to the first end;

a second adjustment extension device coupled to the second end;

each of the first and second adjustment extension devices comprising a gripping member; and a connecting element coupled to the each of the first and second adjustment extension devices, wherein the connecting element comprises an elastic biasing system which causes the gripping members to be bias away from one another.

35. A method of adjusting the protective helmet of claim 34, the method comprising:

moving the gripping members towards each other against the biasing force of the elastic biasing system; and locking the gripping members in a desired position.

36. A protective helmet having a shell that protects a user's head, an inner lining system, an adjustable headband system, wherein the adjusting headband system comprises:

a main headband portion having a first end and a second end;

a first adjustment extension device coupled to the first end;

a second adjustment extension device coupled to the second end;

each of the first and second adjustment extension devices comprising a gripping member; and a connecting element having a portion that is non-movably coupled to each of the first and second adjustment extension devices; and each of the first and second adjustment extension devices being movably coupled to another portion of the connecting element, wherein the connecting element comprises at least one of:

an elastic biasing system adapted to move the gripping members away from one another; and a system that adjustably locks each adjustment extension at a number of positions.

37. A method of adjusting the protective helmet of claim 36, the method comprising:

moving the gripping members towards each other; and locking the gripping members in a desired position.

38. A protective helmet comprising:

a shell adapted to protect a user's head;

an inner lining;

a headband comprising an adjusting device;

the adjusting device including two gripping members adapted to be manually moved towards or away from one another by the user in order to vary a size of the headband; and an elastic biasing system coupled to the headband, wherein the two gripping members have portions which extend downwardly from a plane running through a bottom surface of the headband.

39. A method of adjusting the protective helmet of claim 38, the method comprising:

moving the two gripping members towards each other against the biasing force of the elastic biasing system; and locking the two gripping members in a desired position.

* * * * *